US010919663B2

(12) United States Patent
Jones

(10) Patent No.: US 10,919,663 B2
(45) Date of Patent: Feb. 16, 2021

(54) UNIT DOSE PACKAGING SYSTEM (UDPS) HAVING CHILD RESISTANT LOCKING FEATURE WITH FOCUSED PUSH BUTTON

(71) Applicant: WestRock MWV, LLC, Atlanta, GA (US)

(72) Inventor: Marty Jones, Glen Allen, VA (US)

(73) Assignee: WestRock MWV, LLC, Norcross, GA (US)

( * ) Notice: Subject to any disclaimer, the term of this patent is extended or adjusted under 35 U.S.C. 154(b) by 90 days.

(21) Appl. No.: 16/264,754

(22) Filed: Feb. 1, 2019

(65) Prior Publication Data

US 2019/0233158 A1 Aug. 1, 2019

Related U.S. Application Data

(60) Provisional application No. 62/624,853, filed on Feb. 1, 2018.

(51) Int. Cl.

| | |
|---|---|
| ***B65D 5/38*** | (2006.01) |
| ***B65D 75/36*** | (2006.01) |
| ***B31B 50/26*** | (2017.01) |
| ***B65D 83/04*** | (2006.01) |

(52) U.S. Cl.

CPC ..... *B65D 5/38* (2013.01); *B31B 50/26* (2017.08); *B65D 75/367* (2013.01); *B65D 83/0463* (2013.01); *B65D 2583/0454* (2013.01)

(58) Field of Classification Search

CPC ..... B65D 5/38; B65D 75/367; B65D 75/327; B65D 83/0463; A61J 1/035

USPC ..... 206/531, 538, 528, 1.5

See application file for complete search history.

(56) References Cited

U.S. PATENT DOCUMENTS

| | | | | |
|---|---|---|---|---|
| 4,552,269 | A * | 11/1985 | Chang | B65D 75/5838 229/125.09 |
| 6,047,829 | A | 4/2000 | Johnstone et al. | |
| 6,230,893 | B1 | 5/2001 | Karow | |
| 6,874,636 | B2 * | 4/2005 | Paliotta | B65D 75/327 206/1.5 |
| 8,499,936 | B2 * | 8/2013 | Albrecht | B65D 83/0463 206/528 |
| 2003/0047482 | A1 * | 3/2003 | Jones | B65D 5/4241 206/534 |
| 2004/0188311 | A1 | 9/2004 | Pallotta et al. | |
| 2007/0045149 | A1 * | 3/2007 | Hession | B65D 5/5016 206/538 |

(Continued)

*Primary Examiner* — Steven A. Reynolds
(74) *Attorney, Agent, or Firm* — John Swingle

(57) ABSTRACT

A unit dose paperboard package includes an outer paperboard sleeve and an inner paperboard slide card lockably retained within the outer sleeve. The outer sleeve includes a plurality of panels operatively connected to each other such that a top panel of the plurality of panels includes an inner slide card retaining aperture and an inner slide card releasing button defined thereon. The inner slide card includes an inner slide card retaining and releasing panel. The slide card release button includes a longitudinally extending tab defined by a cut in the sleeve, with a root of the tab between ends of the cut, and with a moveable tab edge opposite the root of the tab. The card retaining aperture extends longitudinally past the moveable tab edge in a first direction, but does not extend longitudinally past the root of the tab in a second direction opposite the first direction.

16 Claims, 6 Drawing Sheets

(56) References Cited

U.S. PATENT DOCUMENTS

| | | | | |
|---|---|---|---|---|
| 2007/0054525 | A1 | 3/2007 | Jones et al. | |
| 2007/0272586 | A1 | 11/2007 | Hession | |
| 2009/0178948 | A1 | 7/2009 | Reilley et al. | |
| 2009/0184023 | A1 | 7/2009 | Briollier et al. | |
| 2011/0068039 | A1 | 3/2011 | Sack et al. | |
| 2014/0346219 | A1* | 11/2014 | Jones | B65D 83/0463 229/136 |
| 2016/0001948 | A1 | 1/2016 | Collins et al. | |

* cited by examiner

UNIT DOSE PACKAGING SYSTEM (UDPS) HAVING CHILD RESISTANT LOCKING FEATURE WITH FOCUSED PUSH BUTTON

REFERENCE TO RELATED APPLICATION

This application claims the benefit of priority under 35 U.S.C. § 119(e) of U.S. provisional application Ser. No. 62/624,853 filed on Feb. 1, 2018, which is hereby incorporated by reference in its entirety.

BACKGROUND OF THE INVENTION

1. Field of the Invention

The present disclosure relates to unit dose packaging systems (UDPSs), and more particularly to child resistant UDPSs.

2. Description of Related Art

Child resistant unit dose packaging systems require pressing a button or tab on an outer sleeve to release a blister back from the sleeve. Once the blisters are clear of the sleeve, a dose can be removed by pressing it out of the blister. The multiple steps required to actually obtain the product from the blister discourage and/or prevent children from being able to remove products from the blister pack.

In traditional child resistant unit dose packaging systems, it may be possible to release the blister pack from the sleeve by pressing near or around the actual button, which in some designs may not meet more stringent child proofing standards.

The conventional techniques have been considered satisfactory for their intended purpose. However, there is an ever present need for improved unit dose packaging systems. This disclosure provides a solution for this need.

SUMMARY OF THE INVENTION

A unit dose paperboard package having a locking feature includes an outer paperboard sleeve and an inner paperboard slide card lockably retained within the outer sleeve, such that the outer sleeve includes a plurality of panels operatively connected to each other such that a top panel of the plurality of panels includes an inner slide card retaining aperture and an inner slide card releasing button defined thereon. The inner slide card includes one or more unit dose dispensing blisters and an inner slide card retaining and releasing panel located adjacent to the one or more unit dose dispensing blisters. The slide card release button includes a longitudinally extending tab defined by a cut in the sleeve, with a root of the tab between ends of the cut, and with a moveable tab edge opposite the root of the tab. The card retaining aperture extends longitudinally past the moveable tab edge in a first direction, but does not extend longitudinally past the root of the tab in a second direction opposite the first direction.

The longitudinally extending tab can have a length extending in a longitudinal direction from the moveable tab edge to the root of the tab, and the card retaining aperture can extend in the longitudinal direction less than one half of the length of the tab from the moveable tab edge towards the root. The card retaining aperture can terminate at either lateral end thereof in a laterally extending wing portion. The top panel can include a plurality of layers, e.g. connected together with the plurality of panels along fold lines, wherein the card retaining aperture is defined as an aperture in an inner layer of the plurality of layers, and wherein the tab of the slide card releasing button is defined in an outer layer of the plurality of layers.

The card retaining aperture can include a catch edge configured to engage the inner slide card retaining and releasing panel to prevent removal of the slide card without depressing the button, and the inner slide card retaining aperture can include a button edge opposite the catch edge, wherein the button edge conforms to a contour of the moveable tab edge of the slide card release button. The cut defining the longitudinally extending tab can include a pair of spaced apart longitudinally extending side portions defining side edges of the longitudinally extending tab, wherein the button edge of the card retaining aperture conforms to the moveable tab edge and a portion of the side edges of the tab. The side portions of the cut defining the longitudinally extending tab can each terminate in a u-shaped terminus. The inner slide card retaining and releasing panel can be hingedly attached along a fold line to the inner slide card, with a catch edge opposite the fold line that engages the catch edge of the slide card retaining aperture to prevent removal of the inner slide card unless the button is depressed. The button and card retaining aperture can be configured so that direct pressing of the button releases the inner slide card, wherein releasing the inner slide card is inhibited for pressing near the button but not on the button A blank for an outer paperboard sleeve for a unit dose paperboard package includes a plurality of panels operatively connected to each other to form a sleeve for receiving an inner slide card with one or more unit dose dispensing blisters, wherein a top one of the panels includes an inner slide card retaining aperture and an inner slide card releasing button defined thereon. The slide card includes a card retaining aperture and a release button with a longitudinally extending tab as described above.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
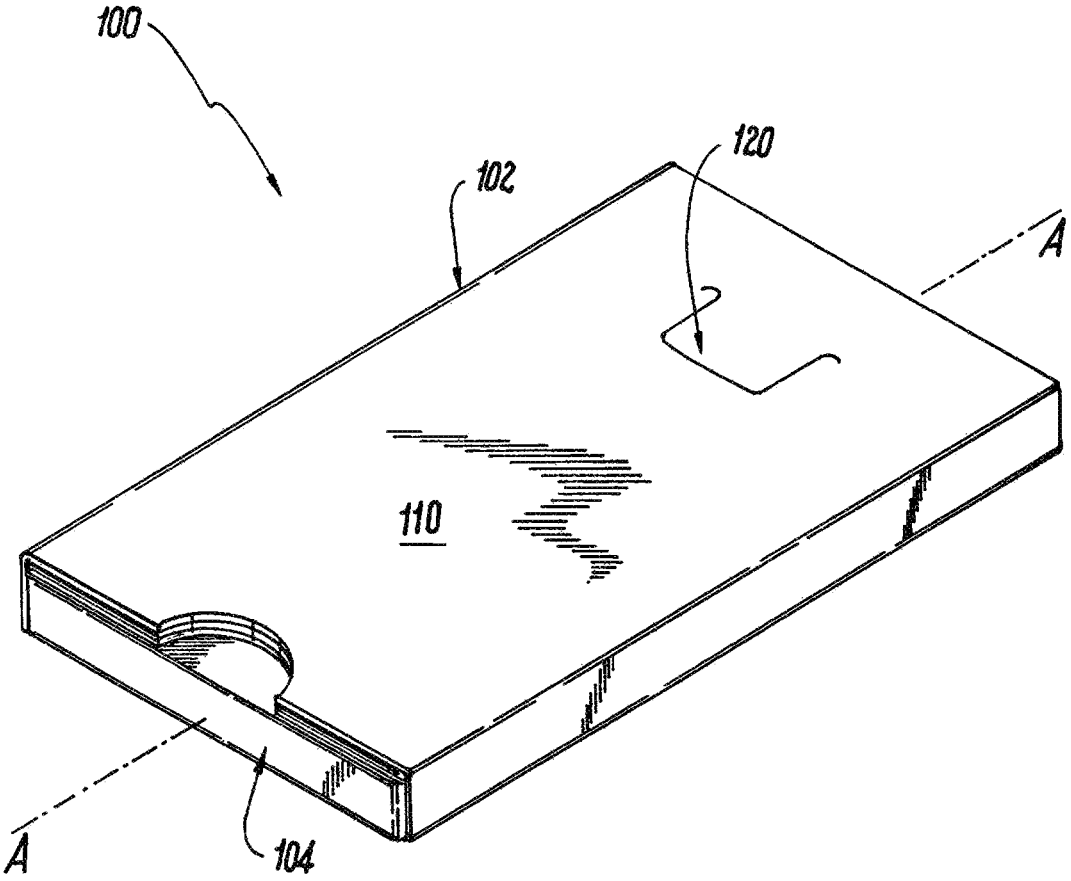
FIG. 1 is a perspective view of an exemplary embodiment of a unit dose paperboard package constructed in accordance with the present disclosure, showing the outer sleeve and the inner slide card assembled together with the inner slide card stored inside the sleeve.
Figure 2:
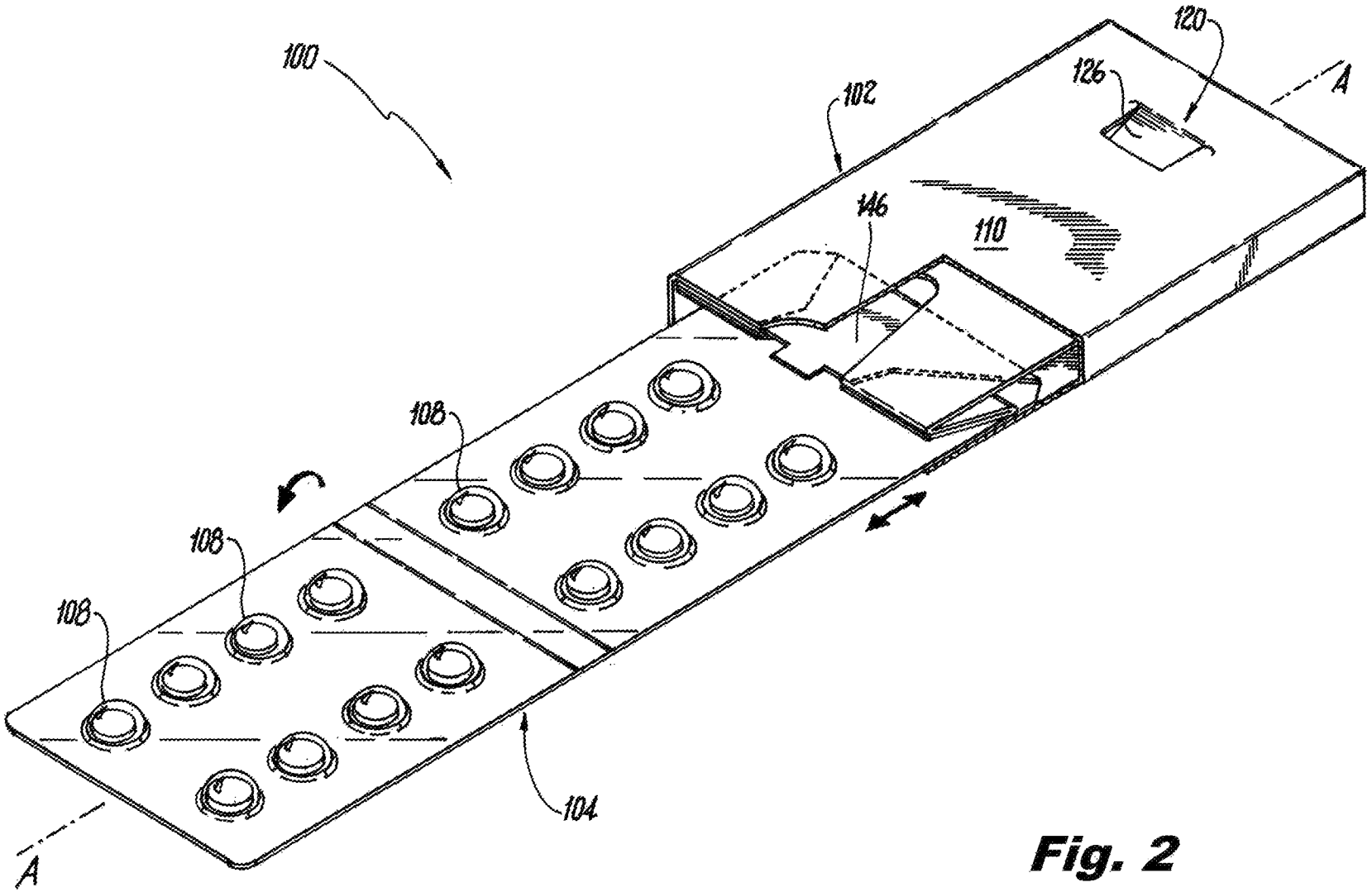
FIG. 2 is a partially cross-sectional perspective view of the sleeve and inner slide card of FIG. 1, showing the inner slide card extended from the sleeve for access to the contents thereof.

Reference will now be made to the drawings wherein like reference numerals identify similar structural features or aspects of the subject disclosure. For purposes of explanation and illustration, and not limitation, a partial view of an exemplary embodiment of a package in accordance with the disclosure is shown in FIG. 1 and is designated generally by reference character 100. Other embodiments of packages in accordance with the disclosure, or aspects thereof, are provided in FIGS. 2-6, as will be described. The systems and methods described herein can be used to prevent access, as in child proofing, to contents in unit dose packaging systems such as for pharmaceuticals.

U.S. Pat. No. 6,047,829 is incorporated by reference herein in its entirety. It provides an explanation of a unit dose packaging system (UPDS), provides an explanation of how to form such a package from a paperboard blank which is assembled into an outer sleeve, provides an explanation of how to form an inner slide card, and provides an explanation for how to assemble the inner slide card into the outer sleeve to provide a locking mechanism in the closed position of the inner slide card and a mechanism for preventing complete removal of the inner slide card from the outer sleeve or shell.

With reference now to FIG. 1, a unit dose paperboard package 100 with a locking feature in accordance with the present disclosure includes an outer paperboard sleeve 102 and an inner paperboard slide card 104 lockably retained within the outer sleeve 102. In a closed position shown in FIG. 1, the button 120 must be depressed in order to unlock the slide card 104 to access the contents of the slide card 104 in the open position shown in FIG. 2. In this open position, the contents of the inner slide card 104, e.g., contained within a plurality of unit dose dispensing blisters 108 of the slide card 104, can be accessed but the slide card 104 cannot be completely removed from the sleeve 102 due to a second locking mechanism described below which retains slide card 104 in the open end of the sleeve 102.

Figure 3:
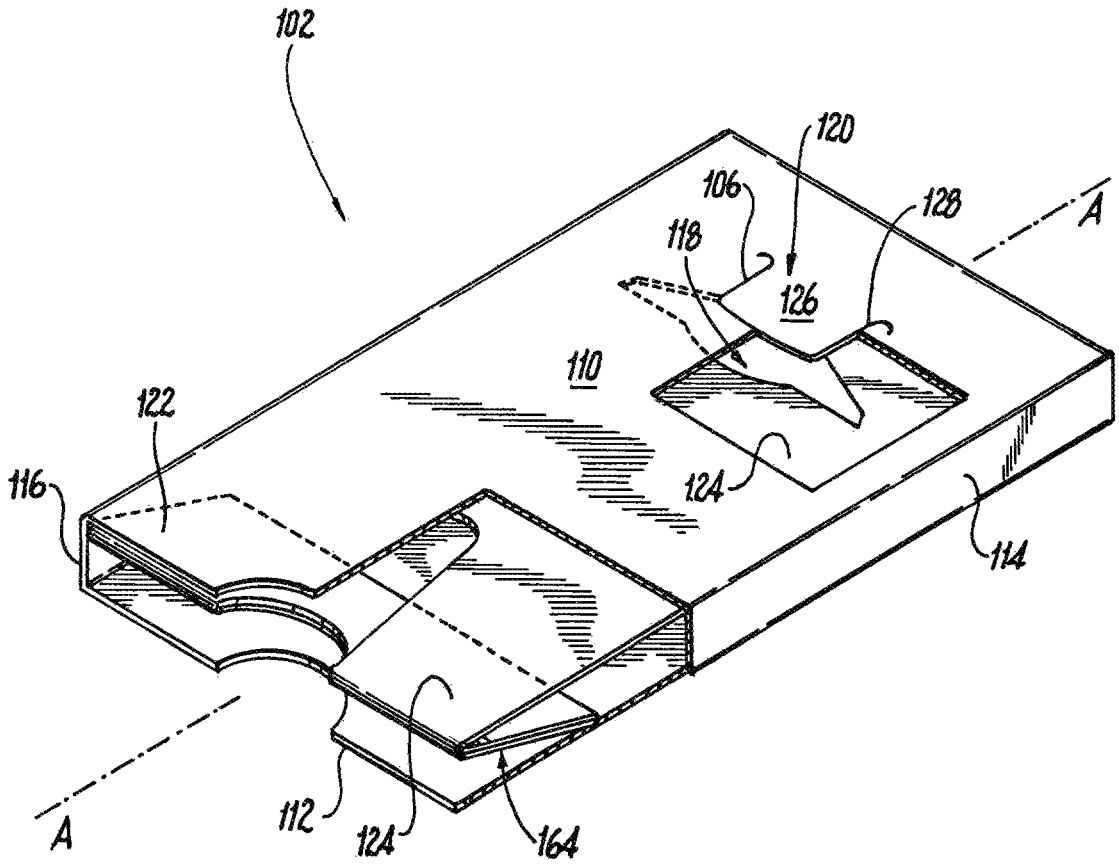
FIG. 3 is a partially cross-sectional perspective view of the sleeve of FIG. 1, showing the sleeve without the inner slide card.
Figure 4:
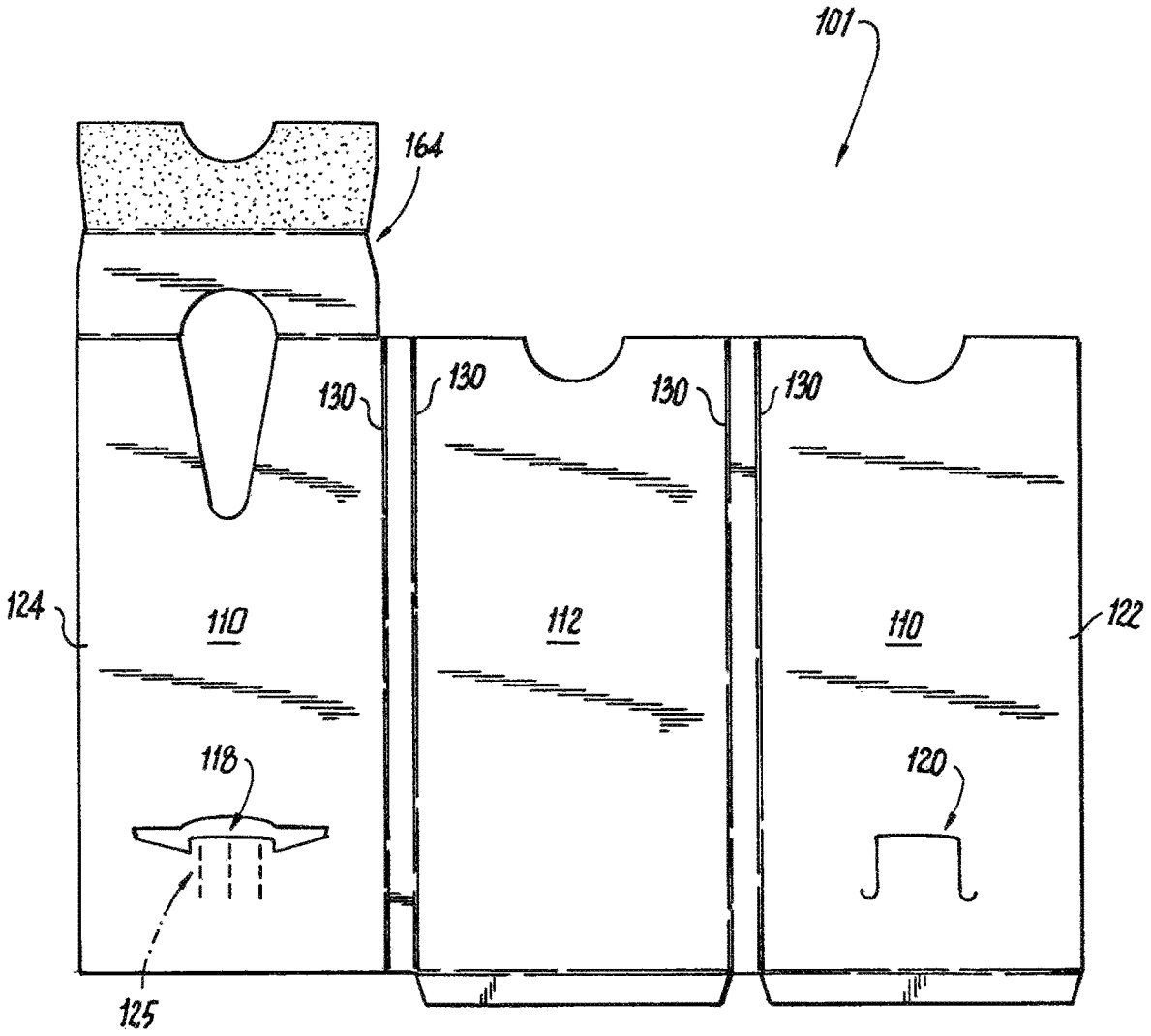
FIG. 4 is a plan view of a blank for the sleeve of FIG. 3, showing the panels with the button and the card retaining aperture.

With reference now to FIG. 3, the sleeve 102 includes a plurality of panels, e.g. panels 110, 112, 114, and 116, operatively connected to each other such that a top panel 110 includes an inner slide card retaining aperture 118 (shown in hidden lines in FIG. 3) and an inner slide card releasing button 120 defined thereon. The top panel 110 includes a plurality of layers 122 and 124, e.g. connected together with the plurality of panels 110, 112, 114, and 116 along fold lines 130 shown FIG. 4, which shows a blank 101 for forming the sleeve 102. The card retaining aperture 118 is defined as an aperture, e.g., cut through, in the inner layer 124 of the top panel 110. There are longitudinal creases 125 formed in the underside of the top panel 110, as oriented in FIG. 4, running toward the card retaining aperture 118, which underlie the button 120 when the sleeve 102 is assembled as shown in FIG. 3. The slide card release button 120 includes a longitudinally extending tab 126 defined by a cut 128 in the outer layer 122 of the top panel 110 of the sleeve 102.

Figure 5:
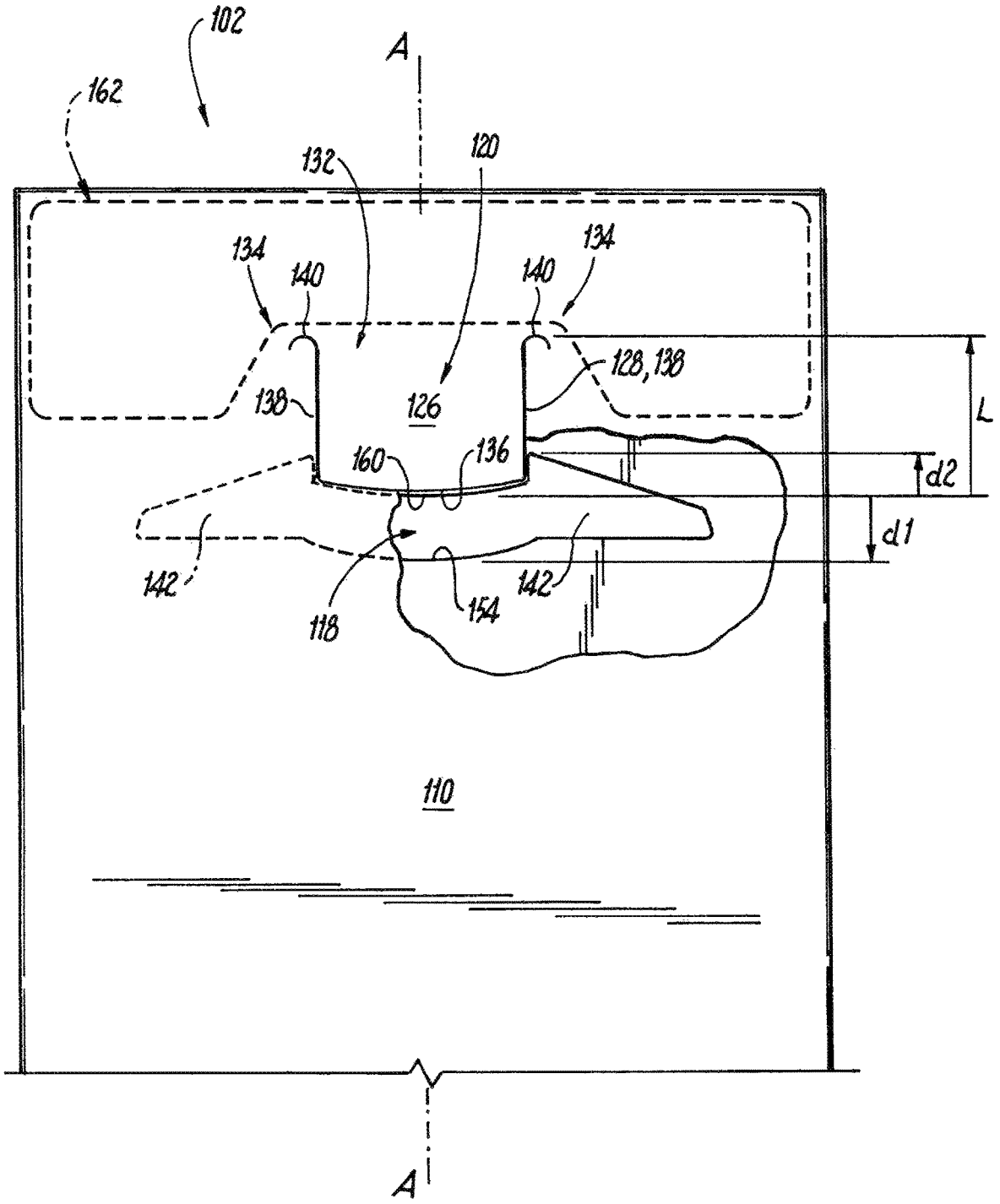
FIG. 5 is a partially cut-away plan view of a portion of the sleeve of FIG. 1, showing the button with the card retaining aperture shown partially in hidden lines.

With reference now to FIG. 5, the tab 126 includes a root 132 of the tab 126 between ends 134 of the cut 128. The tab 126 includes a moveable tab edge 136 opposite the root 132 of the tab 126. The cut 128 defining the longitudinally extending tab 126 includes a pair of spaced apart longitudinally extending side portions 138 defining side edges of the longitudinally extending tab 126. The side portions 138 of the cut 128 each terminate in a u-shaped terminus 140.

The longitudinally extending tab can have a length L extending in a longitudinal direction, e.g., along longitudinal axis A from the moveable tab edge 136 to the root 132 of the tab 126. The card retaining aperture 118 extends longitudinally past the moveable tab edge 136 in a first direction, as indicated by the length d1 in FIG. 5, but does not extend longitudinally past the root 132 of the tab 126 in a second direction opposite the first direction, as indicated by the length d2 in FIG. 5. The card retaining aperture 118 extends in the longitudinal direction less than one half of the length L of the tab 126 from the moveable tab edge 136 towards the root 132, i.e., $d2<0.5 \cdot L$. For example, d2 can be 40% of L. The card retaining aperture 118 terminates at either lateral end thereof in a laterally extending wing portion 142.

Figure 6:
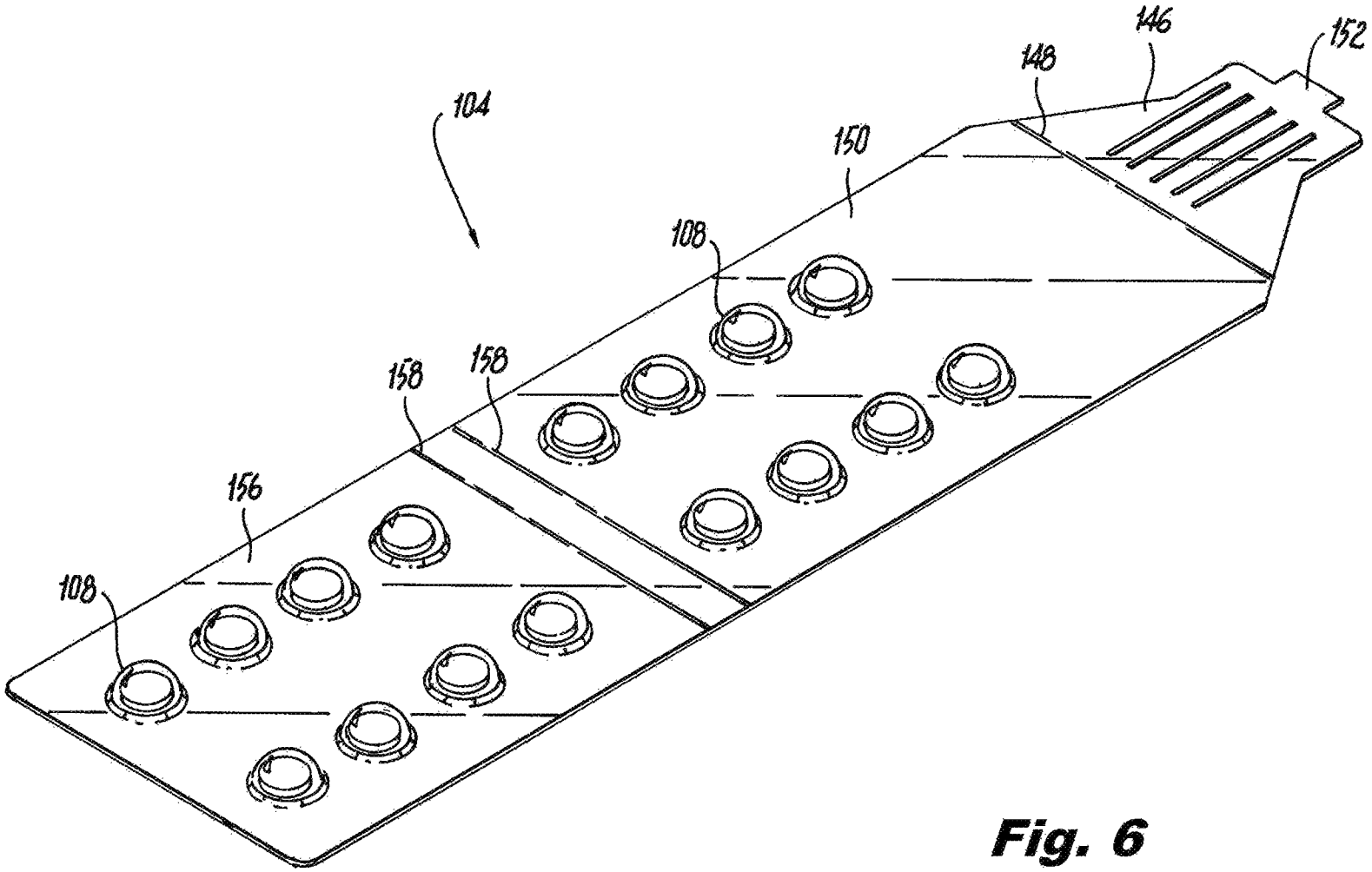
FIG. 6 is a perspective view of the inner slide card of FIG. 1, showing the retaining and releasing panel of the inner slide card.

With reference now to FIG. 6, the inner slide card 104 includes an inner slide card retaining and releasing panel 146 located adjacent to the unit dose dispensing blisters 108. An inner slide card retaining and releasing panel 146 is hingedly attached along a fold line 148 to the main panel 150 of the inner slide card 104. The retaining and releasing panel 146 includes a catch edge 152 opposite the fold line 148 that engages the catch edge 154 (identified in FIG. 5) of the slide card retaining aperture 142 to prevent removal of the inner slide card 104 unless the button 120 is depressed. The inner slide card 104 also includes a second panel 156, which includes additional unit dose dispensing blisters 108, and is connected to the main panel 150 by fold lines 158.

With reference again to FIG. 5, the inner slide card retaining aperture 118 includes a button edge 160 opposite the catch edge 154. The button edge 160 conforms to a contour of the moveable tab edge 136 of the slide card release button 120 and to a portion of the side edges 138 of the tab 126. The button 120 and card retaining aperture 126 are configured so that direct pressing of the button 120 releases the inner slide card 104 when it is in the closed and locked position shown in FIG. 1 so the inner slide card can be opened to the open position shown in FIG. 2, e.g. by lowering the catch edge 152 of the inner slide card 104 to clear the catch edge 154 of the sleeve 102. Releasing the inner slide card is inhibited when pressing near the button 120 but not on the button 120, e.g., pressing at locations in area 162 schematically indicated in FIG. 5.

When in the open position shown in FIG. 1, the extension panel 164 of the sleeve 102 interlocks with the retaining and releasing panel 146 of the slide card 104 to prevent full removal of the slide card 104 from the sleeve 102, much as described in U.S. Pat. No. 6,047,829. Those skilled in the art having the benefit of this disclosure, and the benefit of U.S. Pat. No. 6,047,829, will readily appreciate how to assemble the blank 101 of FIG. 4 into a sleeve 102, how to assemble the slide card 104, and how to assemble the slide card 104 into the sleeve 102 so that improved direct pressing of the button 102 unlocks access to the slide card 104 when in the locked position, in accordance to this disclosure. Since direct pressing of the button 120 is required to release the inner slide card 104, the button press is more focused compared to traditional configurations, improving inadvertent opening and improving child proofing. The button and aperture configuration disclosed herein is also stronger and less likely to tear when pressed very hard compared to traditional configurations.

The methods and systems of the present disclosure, as described above and shown in the drawings, provide for unit dose packages with superior properties including improved child-proofing and durability. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A unit dose paperboard package having a locking feature, comprising:

an outer paperboard sleeve and an inner paperboard slide card lockably retained within the outer sleeve, such that the outer sleeve includes a plurality of panels operatively connected to each other such that a top panel of the plurality of panels includes an inner slide card retaining aperture and an inner slide card releasing button defined thereon;

wherein the inner slide card includes one or more unit dose dispensing blisters and an inner slide card retaining and releasing panel located adjacent to the one or more unit dose dispensing blisters; and wherein the slide card release button includes a longitudinally extending tab defined by a cut in the sleeve, with a root of the tab between ends of the cut, and with a moveable tab edge opposite the root of the tab, and wherein the card retaining aperture extends longitudinally past the moveable tab edge in a first direction, but does not extend longitudinally past the root of the tab in a second direction opposite the first direction;

wherein the longitudinally extending tab has a length extending in a longitudinal direction from the moveable tab edge to the root of the tab, and wherein the card retaining aperture extends in the longitudinal direction less than one half of the length of the tab from the moveable tab edge towards the root.

2. The package as recited in claim 1, wherein the card retaining aperture terminates at either lateral end thereof in a laterally extending wing portion.

3. The package as recited in claim 1, wherein the top panel includes a plurality of layers, wherein the card retaining aperture is defined as an aperture in an inner layer of the plurality of layers, and wherein the tab of the slide card releasing button is defined in an outer layer of the plurality of layers.

4. The package as recited in claim 1, wherein the card retaining aperture includes a catch edge configured to engage the inner slide card retaining and releasing panel to prevent removal of the slide card without depressing the button, and wherein the inner slide card retaining aperture includes a button edge opposite the catch edge, wherein the button edge conforms to a contour of the moveable tab edge of the slide card release button.

5. The package as recited in claim 4, wherein the cut defining the longitudinally extending tab includes a pair of spaced apart longitudinally extending side portions defining side edges of the longitudinally extending tab, wherein the button edge of the card retaining aperture conforms to the moveable tab edge and a portion of the side edges of the tab.

6. The package a recited in claim 5, wherein the side portions of the cut defining the longitudinally extending tab each terminates in a u-shaped terminus.

7. The package as recited in claim 5, wherein the inner slide card retaining and releasing panel is hingedly attached along a fold line to the inner slide card, with a catch edge opposite the fold line that engages the catch edge of the slide card retaining aperture to prevent removal of the inner slide card unless the button is depressed.

8. The package as recited in claim 6, wherein the button and card retaining aperture are configured so that direct pressing of the button releases the inner slide card, wherein releasing the inner slide card is inhibited for pressing near the button but not on the button.

9. An blank for an outer paperboard sleeve for a unit dose paperboard package comprising:

a plurality of panels operatively connected to each other to form a sleeve for receiving an inner slide card with one or more unit dose dispensing blisters, wherein a top one of the panels includes an inner slide card retaining aperture and an inner slide card releasing button defined thereon;

wherein the slide card release button includes a longitudinally extending tab defined by a cut in the sleeve, with a root of the tab between ends of the cut, and with a moveable tab edge opposite the root of the tab, and wherein the card retaining aperture extends longitudinally past the moveable tab edge in a first direction, but does not extend longitudinally past the root of the tab in a second direction opposite the first direction;

wherein the longitudinally extending tab has a length extending in a longitudinal direction from the moveable tab edge to the root of the tab, and wherein the card retaining aperture extends in the longitudinal direction less than one half of the length of the tab from the moveable tab edge towards the root.

10. The blank as recited in claim 9, wherein the card retaining aperture terminates at either lateral end thereof in a laterally extending wing portion.

11. The blank as recited in claim 9, wherein the top panel includes a plurality of layers connected together with the plurality of panels by respective fold lines, wherein the inner card retaining aperture is defined as an aperture in an inner layer of the plurality of layers, and wherein the tab of the slide card releasing button is defined in an outer layer of the plurality of layers.

12. The blank as recited in claim 9, wherein the card retaining aperture includes a catch edge configured to engage an inner slide card retaining and releasing panel to prevent removal of the slide card without depressing the button, and wherein the card retaining aperture includes a button edge opposite the catch edge, wherein the button edge conforms to a contour of the moveable tab edge of the slide card release button.

13. The blank as recited in claim 12, wherein the cut defining the longitudinally extending tab includes a pair of spaced apart longitudinally extending side portions defining side edges of the longitudinally extending tab, wherein the button edge of the card retaining aperture conforms to the moveable tab edge and a portion of the side edges of the tab.

14. The blank a recited in claim 13, wherein the side portions of the cut defining the longitudinally extending tab each terminates in a u-shaped terminus.

15. The blank as recited in claim 13, wherein the button and card retaining aperture are configured so that an inner slide card retaining and releasing panel hingedly attached along a fold line to the inner slide card having a catch edge opposite the fold line can engage the catch edge of the slide card retaining aperture to prevent removal of the inner slide card unless the button is depressed.

16. The blank as recited in claim 15, wherein the button and card retaining aperture are configured so that direct pressing of the button releases the inner slide card, wherein releasing the inner slide card is inhibited for pressing near the button but not on the button.

* * * * *